US006222082B1

(12) United States Patent
Hubbard et al.

(10) Patent No.: US 6,222,082 B1
(45) Date of Patent: Apr. 24, 2001

(54) DIESEL FUEL FOR USE IN DIESEL ENGINE-POWERED VEHICLES

(75) Inventors: William A. Hubbard, Williamsburg, VA (US); Reginald N. Spencer, Towson, MD (US)

(73) Assignee: Leonard Bloom, Towson, MD (US); a part interest ( * ) Notice: Subject to any disclaimer, the term of this patent is extended or adjusted under 35 U.S.C. 154(b) by 0 days.

(21) Appl. No.: 09/391,935

(22) Filed: Sep. 8, 1999

(51) Int. Cl.[7] ..... C10L 1/14
(52) U.S. Cl. ..... 585/14; 44/300
(58) Field of Search ..... 44/300; 585/14

(56) References Cited

U.S. PATENT DOCUMENTS

| | | | | |
|---|---|---|---|---|
| 5,389,111 | | 2/1995 | Nikanjam et al. . | |
| 5,389,112 | | 2/1995 | Nikanjam et al. . | |
| 5,681,358 | * | 10/1997 | Spencer et al. | 44/300 |
| 5,730,762 | | 3/1998 | Murakami et al. . | |
| 5,792,339 | | 8/1998 | Russell . | |
| 5,814,109 | | 9/1998 | Cook et al. . | |
| 5,853,433 | * | 12/1998 | Spencer et al. | 44/300 |

* cited by examiner

*Primary Examiner*—Jacqueline V. Howard
(74) *Attorney, Agent, or Firm*—Leonard Bloom

(57) ABSTRACT

A special fuel is formulated for use with diesel engines, which are employed to power vehicles such as trucks, buses, tractors and boats.

3 Claims, 1 Drawing Sheet

DIESEL FUEL FOR USE IN DIESEL ENGINE-POWERED VEHICLES

FIELD OF THE INVENTION

The herein disclosed invention finds applicability in the field of diesel fuels, and more particularly to be used in vehicles such as trucks, buses, tractors, boats, earthworking equipment and the like.

BACKGROUND OF THE INVENTION

Normal diesel fuel is unstable. This instability is due to the presence in normal diesel fuel of various olefins, free radicals, sulphur compounds and other reactive materials which can polymerize and react to form materials that impede the engine operation by plugging up fuel lines and filters, as well as fuel injection ports. Gasoline is much worse than diesel fuel in this respect but diesel fuels still can cause problems if stored for period of a year or longer. The diesel fuel of this invention is designed to remedy these problems.

Diesel engines have better gas mileage, lower fuel cost and are more durable than gasoline engines, so they are mounted on trucks, buses, watercraft and the like. The number of diesel engines in use increases each year. Sulfur contained in diesel fuel has presented a problem in pollution control.

Large diesel trucks belch out millions of tons of smog-causing chemicals and microscopic soot, yet face far weaker environmental controls than cars.

While the government pushes for cleaner-running cars and sport utility vehicles, the environmentalists complain that not enough is being done to cut pollution from the more than 5 million tractor-trailer rigs, dump trucks and other heavy vehicles. There is probably no more offensive air pollution than the thick, noxious pollution from big trucks. Environmentalists seek a cleaner burning diesel fuel, along with tougher emission controls on the smoke-belchers.

The Environmental Protection Agency has begun considering a requirement for low-sulfur diesel fuel, although no specific regulations have been issued.

Pollution from large trucks is gaining increased attention as the EPA is proposing dramatically tougher emission controls on cars and popular sport utility vehicles, as well as cutting sulfur content in gasoline by 90 percent.

Trucks, although far smaller in numbers, comprise an equally huge air pollution source as automobiles.

The 5 million large trucks account for 3 million tons of smog-causing nitrogen oxide annually and half of the fine particulates, or soot, that come from mobile sources. Diesel fuel contains almost twice as much sulfur as even today's gasoline. Sulfur inhibits proper performance of pollution control equipment.

Unlike cars, large trucks are not required to have pollution-controlling catalytic converters, nor are they subject to annual emission inspections.

Tailpipe pollution from diesel trucks includes large amounts of soot, which is particularly dangerous because the microscopic particles imbed deeply into the lungs. Furthermore, diesel particles also are toxic and may cause cancer.

Prior Art Patents Murakami et al U.S. Pat. No. 5,730,762 teach a diesel fuel of reduced sulfur content which contains an alkyl side chain on the aromatic ring and also contains hetero nitrogen compounds with an alkyl side chain. The composition also includes carbazole and indole compounds as components of the fuel composition.

Nikanjam et al U.S. Pat. No. 5,389,112 disclose a diesel fuel with low aromatic content and high cetane number. There are controlled amounts of aromatics in the fuel to produce an optimum cetane number as defined by a graph set forth in the patent. The fuel can also have added thereto a cetane improver. The composition also includes 2-ethylhexylnitrate as the cetane improver.

Cook et al U.S. Pat. No. 5,814,109 teach an additive for improving cetane number and/or lubricity of diesel fuel. The additive is prepared by the Fischer-Tropsch hydrocarbon synthesis. The composition also includes $C_{14}$–$C_{16}$ linear primary alcohols.

Russell in U.S. Pat. No. 5,792,339 discloses a diesel fuel which minimizes the production of pollutants from vehicles by adjusting the amounts of aromatic compounds in the fuel. The composition also includes polycyclic aromatics of between 5.0 to 8.6 weight %.

None of the prior art references discloses diesel fuels for diesel engines used to power vehicles such as trucks, buses and boats which is formulated to produce less pollution and run the engine efficiently.

OBJECTS OF THE INVENTION

An object of this invention is to produce an improved diesel fuel.

A further object is to produce a diesel fuel which will start-up and run vehicular engines without problems. The fuel will perform well at low temperatures.

An important object of this invention is to produce a diesel fuel which will efficiently operate in a diesel motor without causing undue pollution. The product will produce lower levels of exhaust pollutants.

A still further object of this invention is to produce a diesel fuel which will be free of microbiological contamination and has long-term storage stability.

A significant object of the invention is to produce a fuel with an adequate cetane number for smooth operation.

A special object of this invention is to produce a fuel formulated to produce adequate anti-wear properties in the engine.

SUMMARY OF THE INVENTION

The diesel fuel of this invention is low in odor, with regard to both the odor of the fuel itself and the odor of the exhaust, and in addition the fuel is stable and will not degrade during long periods of storage. When used (albeit intermittently), the premium diesel fuel of this invention is kinder to the environment because it would have a less obnoxious exhaust odor and fuel odor. It does not have the black, smoky exhaust normally associated with diesel engines, and the exhaust emissions contain a lower level of pollutants as compared with regular diesel emissions. The diesel fuel will provide for easy start of diesel engines. These are the primary benefits of the present invention.

Figure 1:
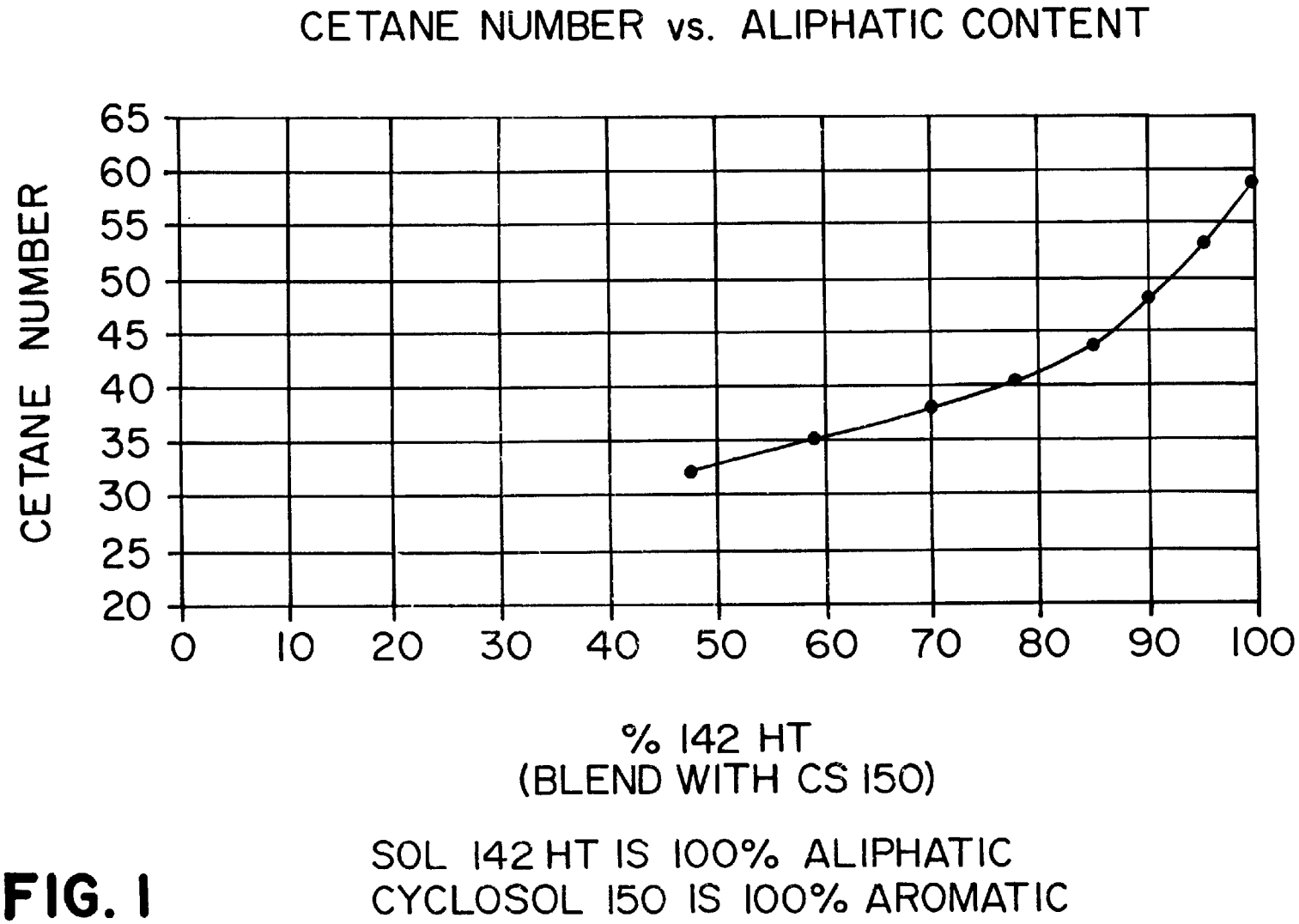
FIG. 1 is a graph showing the cetane number vs. aliphatic content.

The inventors have developed a diesel fuel which they believe will satisfactorily address all of the issues of concern raised above. There are many different compositions that could be used but one that would be satisfactory is described as follows:

DESCRIPTION OF THE INVENTION

Representative fuel compositions are as follows:

| | |
|---|---|
| Shell's Sol 142HT (aliphatic) | 75 to 100% vol. |
| Shell's Cyclo Sol 150 (aromatic) | 25 to 0% vol. |
| "Fuel Saver" (Angus Chem.) | 500 ppm (a biocide) |
| Anti-wear additive-if needed | As specified |
| Cetane number improver-if needed | As specified |
| Freeze point depressant-if needed | As specified |

The two Shell products named above are mineral spirits with flash points above 140F. The 142 HT is 99.7% aliphatic while the Cyclo Sol 150 is 99.8% aromatic. Both have a very low sulphur content—in the range 1 to 2 ppm. Typical diesel fuels contain much more sulphur, in the range of 0.05%. Typical diesel fuels must have a flash point above 125° F., so these products would be efficient for operating diesel powered vehicles. The diesel fuels of this invention deal with and solve the following problems.

1. LONG TERM STORAGE STABILITY: Typical diesel fuels contain a great variety of olefins, sulfur compounds, and cyclic aromatics that are unstable in long term storage and tend to develop gums and sludge over time. The formula of this invention contains essentially none of the sulphur and olefins; and the aromatics, if added, are very stable in storage.

2. BIOCIDE: The new diesel fuel can have a biocide added in quantities large enough to kill existing organism with enough left over to kill organisms introduced into the fuel during storage.

3. EASE OF STARTING: Based on three factors, the new diesel fuel offers easier starting. First, the autoignition temperature of the main ingredient, Sol 142HT, is only 452° F. This is a bit lower than ordinary diesel fuels which may run at 465° F. to 470° F. There is no direct correlation between autoignition temperatures and ease of starting because other factors play a part but this offers a slight advantage. Second, the fuel is extremely fluid as compared with the heavier typical diesel fuel so it is much easier to disperse into a fine mist through the fuel injectors. This makes the fuel droplets smaller so that they heat faster after the compression stroke thus leading to easier starting. Third, the fuel is more volatile than regular diesel fuel with a 90% distillation range at about 400F as compared with 550 to 600F for conventional fuels. This means that the fuel droplets will vaporize much more readily and this vapor/air mixture will bum more readily at the autoignition temperature, making starting easier.

4. ENGINE WEAR: In a diesel fuel, the presence of sulphur compounds helps provide lubrication to the moving parts that come in contact with the fuel and the combustion products. As the sulphur content is decreased, the engine wear increases. In the case of the newly formulated diesel fuel, the sulphur content is almost nil so that it may be desirable to use a lubricity additive. A number of such products are available and they should be used in accordance with their manufacturer's instructions.

5. CETANE NUMBER IMPROVER: A large variety of diesel engines are in use. The cetane requirements vary from engine to engine. It will be possible to produce one or two grades of newly formulated diesel fuel which will meet the great bulk of the needs of the market. A cetane number improver can be considered and added if necessary.

6. ENVIRONMENTAL CONCERNS: Diesel fuels have become famous for their high sulphur content and their foul exhausts. This has led to increasing regulation of their maximum sulphur content. The diesel fuel of this invention is in a very strong position in this regard with the sulphur content in the range of 1 to 2 ppm.

The inventors have solved the above set forth problems by formulating a quality diesel fuel by using, as the diesel fuel, mineral spirits that have been refined to eliminate the olefins, sulfur, free radicals and other reactive materials. This provides a fuel that is completely stable in long-term storage while also providing a fuel that is cleaner-burning and much lower in odor.

Various mineral spirits could be used in the diesel fuel of this invention and they would have the following properties:

1. They would be refined so as to be essentially free of olefins, sulfur, free radicals and other reactive materials and they would therefore be stable in long-term storage.
2. They would have a flash point consistent with the diesel fuel that they would replace. This would certainly be above 100° F. but it might even be above 140° F. in some cases.
3. They would have a much narrower boiling range than regular diesel fuel and would probably exclude the heavy ends boiling above 475° F. or 500° F. and higher.
4. They would have a cetane number that would be high enough for normal operation of the engine in which they are to be used. This rating might range from 40 to 60 or even higher.
5. For practical purposes, they would be available at reasonable costs.

Shell Oil and a great many other petroleum refiners produce mineral spirits which could perform as premium diesel fuels. Some of the Shell mineral spirits that could be used are as follows: Sol 340HT, MS 146HT, MS 200HT. All conventional diesel fuels have flash points above 125° F. Sol 142HT has a flash point of 145° F.

All of these are straight-run materials and have not been subjected to a cracking operation. All have been hydrogen treated ("HT") which essentially eliminates the olefins and the sulfur. They are quite stable in long-term storage. The octane rating on these products is only about 40 so the cetane rating should be very good.

The final premium diesel fuel of the present invention is exemplified by one of the above materials, and has a boiling range from 320° F. to 350° F. or up as high as 402° F. depending on the material used. Also, the Sol 142HT could be blended 50/50 with any of the other material listed above to give a boiling range of 320° F. to 402° F. This top boiling range could probably be increased up to 475 or 500° F. by blending with a straight run fraction having a higher boiling range with an end point in the 475 to 500° F. area. These blends will perform as a premium fuel if the products are hydrogen treated. It is possible that premium performance could be obtained without hydrogen treating by judicious selection of feed stocks, proper removal of sulphur and proper distillation to remove the heavy ends. However, it is very probable that a good product would be made better by the hydrogen treating.

The improved vehicular diesel fuel of this invention (in one of its preferred compositions) will contain 27% aromatics and 73% aliphatics by volume; however, the range can vary as, for example, about 0–35% aromatics and about 65–100% aliphatics by volume. Within these ranges, those skilled in the art will be able to determine working, as well as optimum ranges.

Many advantages accrue from the use of the instantly disclosed diesel fuel to be used in emergency situations in conjunction with diesel motors employed to power electric generators.

1. Excellent long term storage stability.
2. A biocide content that would protect against the build-up of molds or bacteria.
3. Easy starting after a long period of no engine use.
4. Proper lubricity for reduced engine wear.
5. Adequate cetane number for the purpose intended.
6. A gel or freezing point low enough for the climate where the fuel will be used. For example, down to −40° F. depend on climate.
7. A sulphur content low enough so that the exhaust will meet environmental concerns.

The high aliphatic-low aromatic mineral spirits diesel fuel of this invention will when formulated have the following properties.

| PROPERTY | RANGE | OPTIMUM |
|---|---|---|
| Cetane Number | 40 to 60 | 40 to 55 Depending on engine and use |
| Flash Point (Tag Closed Cup) | 125 to 155° F. | 145° F. |
| Sulfur Content | 1 to 10 ppm | 5 ppm |
| Auto Ignition Temp. F | 450 to 500 F | 455° F. |
| Distillation Range F | 1BP 345 to 375<br>90% Rec. 370 to 450 | 368<br>382 |
| Gel or Freeze Point | Below −40 F | Below −40 F |

The inventors have formulated an effective diesel fuel with different blends of Shell's 142 HT (100% aliphatic with a flash point over 140° F.) blended with 0%, 15% and 30% Shell's Cyclo Sol 150 (a high boiling, 100% aromatic with a flash point in excess of 140° F.). Shell's 142 HT is 100% aliphatic and CS 150 is 100% aromatic.

A more complete description of Sol 142 HT and CS 150 is to be found in Shell chemical catalogs available to the public.

The data were plotted on a graph (FIG. 1) and an extrapolation gives the other two numbers shown at the right below.

| Blend Composition | Cetane Number |
|---|---|
| 100% Sol 142 HT | 59.3 |
| Extrapolated: 7.5% CS 150 | 51 |
| 85% Sol 142 HT, 15% Cyclo Sol 150 | 44.0 |
| Extrapolated: 22.5% CS 150 | 40 |
| 70% Sol 142 HT, 30% Cyclo Sol 150 | 35.8 |

The Sol 142 HT alone would make a very high quality diesel fuel with regard to cetane number and ease of starting. It would require a lubricating additive to give it the desired lubricity because it contains no aromatics which provide some lubricity.

Using the extrapolated value above, the blend containing 7.5% CS 150 could be a satisfactory diesel fuel if a cetane improver additive were incorporated to raise the cetane number to about 55. Such an additive can raise the cetane number by 5 to 6 numbers. Because the aromatic content is still very low, it would probably benefit from the use of a lubricity additive.

Even the blend containing 30% CS 150 could be used as a diesel fuel if an additive were used to raise the cetane number from the 35.8 shown above to something above 40.

For ease of starting, a higher cetane number is desirable. Anything above 40 should be an improvement.

To summarize, straight 142 HT plus a lubricity additive would probably be the best high-quality diesel fuel. This could be used in automotive or emergency generator equipment. Some aromatic could be used in the form of Cyclo Sol 150 if this proved desirable in order to extend the supply of the 142 HT or to reduce the cost.

The new diesel fuel formula of the present invention as defined herein meet these enumerated requirements and is a novel solution to the problem presented by existing diesel fuels.

The diesel fuel can be mineral spirits which have an aromatic content of up to approximately thirty-five percent (for example).

The method further includes the step of providing a biocide in the fuel. If the chosen biocide is "Fuel Saver"™, produced by Angus Chemical Co, it could be used and, preferably, in the range of 100 to 500 ppm. Other biocides could be employed at their recommended use-levels.

The fuel of the present invention is applicable to vehicular diesel engines which, typically, may be in the range of up to 3,000 HP (for example).

The fuel of this invention can be selected from a member of the group consisting of mineral spirits, aliphatics, aromatics and mixtures thereof, said fuel having a low sulfur content, a flash point above 125° F., an autoignition temperature which can be in the range of 445 ° F. to 465° F., will remain fluid at cold temperatures, and have a 90% distillation in the range of 345 ° F. to 450 ° F. producing efficient fuel vaporization and facilitate starting. Shell's Sol 142 HT mineral spirits has an autoignition temperature of around 452° F.

An added advantage of the improved diesel fuel is its ability to be used in cold weather where starting the diesel engine may be difficult.

Because the alternative diesel fuel of the present invention has such a high flash point, it may be stored safely for relatively long periods of time, without deterioration, and this is another, and important, benefit of the present invention. Problems of engine malfunction (due to fuel deterioration) are avoided, engine maintenance may be reduced, and fast engine starting may be assured by using the non-deteriorating diesel fuel of the present invention.

The herein disclosed invention contemplates a diesel fuel for powering vehicular diesel engines having a low sulfur content, a flash point above 125° F., an autoignition temperature in the range of about 445° F. to 465 ° F., will remain fluid at cold temperatures e.g. to −40° F. and has a 90% distillation range at about 345 ° F. to 450 ° F. producing efficient fuel vaporization and facilitating starting of vehicular diesel engines. Also contemplated by this invention is the method of operating a vehicular diesel engine, the improvement which comprises the step of filling the reservoir tank with a fuel for powering said vehicular diesel engine said fuel having, a) a flash point over 125° F.,
b) a 90% distillation in the range of about 350 ° F. to 450 ° F.,
c) a cetane number in the range of about 40 to 60,
d) a low sulfur content in the range of about 1 to 10 ppm, and.
e) an autoignition temperature in the range of about 445° F. to 465° F.

Viewed another way, this invention envisions a method for operating a vehicular diesel engine comprising the step of supplying to said engine a diesel fuel comprising about 0 to 35% petroleum aromatics and 65 to 100% petroleum aliphatics by volume and preferably the method comprises supplying to said engine a diesel fuel comprising approximately 27% petroleum aromatics and 73% petroleum aliphatics. In addition, the fuel for diesel engines will power cars, trucks, busses, farm and earthworking equipment, boats and other vehicles and consisting essentially of aliphatic mineral spirits in the range of 65% to 80% and aromatic mineral spirits in the range of 20% to 35% by volume and preferably the fuel will be aliphatic mineral spirits approximately 73% and the aromatic mineral spirit approximately 27% by volume.

It is possible to formulate the diesel fuel so that there is present 10% aromatic mineral spirits and 90% aliphatic mineral spirits. Moreover, the fuel may contain approximately 100% aliphatic mineral spirits with substantially no aromatic mineral spirits. While the diesel fuel of this invention can be formulated as having 100% aliphatic mineral spirits and no aromatic mineral spirits, however, it may be beneficial to have the composition contain 10% aromatic mineral spirits.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. The method of operating a vehicular diesel engine, the improvement which comprises the step of filling the reservoir tank with a fuel for powering said vehicular diesel engine said fuel having, a) a flash point of 125 ° F. to 155° F., b) a 90% distillation in the range of about 345 ° F. to 450 ° F., c) a cetane number in the range of about 40 to 65, d) a low sulfur content in the range of about 1 to 10 ppm, and e) an autoignition temperature in the range of about 445° F. to 500° F.

2. A method for operating a vehicular diesel engine comprising the step of supplying to said engine a diesel fuel comprising about 0 to 35% aromatics and 65 to 100% aliphatics by volume.

3. The method for operating a vehicular diesel engine of claim 1, further including the step of supplying to said engine a diesel fuel comprising approximately 27% aromatics and 73% aliphatics.

* * * * *